US011142933B2

(12) United States Patent
Sander

(10) Patent No.: US 11,142,933 B2
(45) Date of Patent: Oct. 12, 2021

(54) HINGE

(71) Applicant: Hettich-ONI GmbH & Co. KG, Vlotho (DE)

(72) Inventor: Felix Sander, Kirchlengern (DE)

(73) Assignee: Hettich-ONI GmbH & Co. KG, Vlotho (DE)

( * ) Notice: Subject to any disclaimer, the term of this patent is extended or adjusted under 35 U.S.C. 154(b) by 0 days.

(21) Appl. No.: 16/620,040

(22) PCT Filed: Jun. 1, 2018

(86) PCT No.: PCT/EP2018/064446
§ 371 (c)(1),
(2) Date: Dec. 6, 2019

(87) PCT Pub. No.: WO2018/224402
PCT Pub. Date: Dec. 13, 2018

(65) Prior Publication Data

US 2020/0095812 A1 Mar. 26, 2020

(30) Foreign Application Priority Data

Jun. 9, 2017 (DE) ..... 10 2017 112 767.4

(51) Int. Cl.
*E05D 7/04* (2006.01)
*E05D 7/12* (2006.01)

(52) U.S. Cl.
CPC ..... *E05D 7/0415* (2013.01); *E05D 7/123* (2013.01); *E05D 2007/0461* (2013.01);
(Continued)

(58) Field of Classification Search
CPC ..... E05D 7/0415; E05D 7/123; E05D 7/0407; E05D 7/125; E05D 2900/20; Y10T 16/5358; Y10T 16/554
See application file for complete search history.

(56) References Cited

U.S. PATENT DOCUMENTS 4,799,289 A * 1/1989 Grass ..... E05D 7/125 16/236
4,882,808 A * 11/1989 Rock ..... E05D 7/125 16/240

(Continued)

FOREIGN PATENT DOCUMENTS

DE 8530987 U1 3/1987
DE 29902768 U1 1/2000

(Continued)

OTHER PUBLICATIONS

International Search Report of PCT/EP2018/064446, dated Sep. 11, 2018.

(Continued)

*Primary Examiner* — Victor D Batson
*Assistant Examiner* — Matthew J Sullivan
(74) *Attorney, Agent, or Firm* — Collard & Roe, P.C.

(57) ABSTRACT

A hinge, in particular a multi-joint hinge, has a mounting plate fixable on a body or a door and a side part, which is held on the mounting plate and on which a hinge part is pivotably mounted, wherein the side part is displaceable on the mounting plate in a longitudinal direction via a depth adjustment unit and the side part is pivotable in relation to the mounting plate by a vertical adjustment unit.

12 Claims, 8 Drawing Sheets

(52) U.S. Cl.
CPC ..... *E05D 2007/0469* (2013.01); *E05D 2007/0484* (2013.01); *E05Y 2201/682* (2013.01); *E05Y 2600/528* (2013.01); *E05Y 2900/20* (2013.01)

(56) References Cited

U.S. PATENT DOCUMENTS 5,930,883 A * 8/1999 McWhirt ..... E05D 7/125 16/235
5,937,479 A * 8/1999 Ohshima ..... E05D 7/125 16/257
6,032,333 A * 3/2000 Brustle ..... E05D 7/0407 16/240
6,148,479 A * 11/2000 Lin ..... E05D 7/125 16/236
6,553,621 B2 4/2003 Isele
6,675,440 B1 * 1/2004 Lautenschlager ..... E05D 7/125 16/258
6,918,158 B2 7/2005 Isele
7,178,199 B2 * 2/2007 Kashiwaguma ..... E05D 7/125 16/258
8,205,298 B2 * 6/2012 Lin ..... E05F 5/006 16/287
8,904,599 B2 * 12/2014 Migli ..... E05D 7/125 16/258
9,169,681 B2 * 10/2015 Cooper ..... E05F 5/006
10,060,169 B2 * 8/2018 Chen ..... E05D 7/0415
10,081,975 B2 * 9/2018 Cooper ..... E05F 5/02
10,214,951 B2 * 2/2019 Liang ..... E05F 3/20
10,240,377 B2 * 3/2019 Arai ..... E05D 7/0415
2001/0016967 A1 * 8/2001 Isele ..... E05D 7/125 16/236
2013/0239363 A1 * 9/2013 Apur ..... E05F 5/006 16/50
2014/0115826 A1 * 5/2014 Nuckolls ..... E05D 7/0423 16/235

FOREIGN PATENT DOCUMENTS

DE 20319539 U1 3/2004
EP 1128012 A2 8/2001
EP 2176486 A1 4/2010
JP 03183882 A 8/1991
JP 1193496 A 4/1999
WO 2009083152 A1 7/2009

OTHER PUBLICATIONS

German Search Report dated Nov. 17, 2017 issued in corresponding German Application 10 2017 112 767.4 (with English translation of relevant parts).

* cited by examiner

HINGE

CROSS REFERENCE TO RELATED APPLICATIONS

This application is the National Stage of PCT/EP2018/064446 filed on Jun. 1, 2018, which claims priority under 35 U.S.C. § 119 of German Application No. 10 2017 112 767.4 filed on Jun. 9, 2017, the disclosures of which are incorporated by reference. The international application under PCT article 21(2) was not published in English.

BACKGROUND OF THE INVENTION

The present invention relates to a hinge, in particular a multi-joint hinge, having a mounting plate fixable on a body or a door and a side part, which is held on the mounting plate and on which a hinge part is pivotably mounted, wherein the side part is displaceable on the mounting plate in a longitudinal direction via a depth adjustment unit and the side part is pivotable in relation to the mounting plate by a vertical adjustment unit.

EP 2 176 486 B1 discloses a hinge which comprises a mounting plate fixable on a body, on which a side part is adjustably held via an adapter, wherein two adjustment mechanisms are provided for this purpose. A hinge part is then pivotably mounted on the side part, so that the alignment of a door held on the hinge part can be adjusted. Such an adjustment mechanism has proven itself per se, however, a variety of components is required.

WO 2009/083152 discloses a furniture hinge having two fitting parts, which are displaceable in relation to one another. Moreover, an eccentric is provided, which can ensure a sliding movement, on the one hand, and moreover also enables a certain pivoting movement of the fitting parts by way of the use of an elastically deformable clamping element. However, the adjustment travel is limited due to the elastically deformable clamping element, and moreover damage can result in the event of high contact pressure forces.

SUMMARY OF THE INVENTION

It is therefore the object of the present invention to provide a hinge, which enables an adjustment of a side part in relation to a mounting plate using simple means and moreover can be mounted rapidly on a furniture body.

This object is achieved by a hinge having the features of claim 1.

In the hinge according to the invention, a mounting plate and a side part adjustable via a depth adjustment unit and a vertical adjustment unit are provided, wherein the side part is fixed on the mounting plate via a catch element and is latched with a bolt, which is displaceably mounted in particular in the mounting plate or the side part. The side part can thus be held displaceably on the mounting plate and additionally pivotably without the provision of an additional adapter, so that mounting and a corresponding adjustment movement can be executed using few components. The side part may also be mounted particularly easily by the catch element and in particular secured against lifting off from the mounting plate.

The hinge is preferably designed as a multi-joint hinge, so that the side part is movably connected to a further hinge part, such as a hinge cup, via at least four joints.

The catch element, the bolt, and the side part preferably form a unit which is displaceably held on the mounting plate.

The catch element comprises at least one hook element, which preferably partially encloses the bolt, for example, by at least 100 to 130°. The bolt can be arranged in this case in a recess, in particular an oblong hole, of the mounting plate or side part, so that the bolt is displaceable together with the side part. The side part is preferably rotatably mounted on the bolt for a vertical adjustment, so that the bolt is used both for the depth adjustment and also for the vertical adjustment.

For an effective mounting, the catch element can be fixed on the side part or the mounting plate, in particular displaceably and/or spring-loaded on one side, wherein webs can be formed for this purpose on the catch element, which are inserted into openings of the side part to fix the catch element on the side part. The catch element can be provided in the same manner on the mounting plate, wherein the bolt is then arranged on the side part. Other fastening mechanisms can also be used, and optionally the catch element can also be integrally formed with the side part or the mounting plate.

In a further embodiment, the catch element is formed as a U-shaped molded part, which has a hook element on two legs, each of which engages behind the bolt and secures the side part against lifting off from the mounting plate.

The legs of the catch element are preferably arranged in the locked state in a recess, in particular a recess like an oblong hole, of the mounting plate. This has the advantage that the hinge can be constructed as compact and small as possible.

A rotatable worm, in which one or more projections engage, can be provided for the depth adjustment unit. A worm is understood in this case as a groove formed in a spiral shape. The worm can be fastened captively in an opening of the side part, in particular pressed in, in this case and the projections can preferably be integrally formed on the mounting plate. Other depth adjustment units, such as eccentrics, can also be used.

The vertical adjustment unit preferably comprises a threaded bolt, which is held so it is rotatable, but is not axially displaceable, in an opening of the side part, for example, by pressing in at an opening. The vertical adjustment unit can be engaged in this case with a threaded section on a U-shaped receptacle of the mounting plate.

A vertical adjustment is understood as a support adjustment of the side part in relation to the mounting plate, whereby the distance between side part and mounting plate may be changed vertically in relation to the depth adjustment direction.

BRIEF DESCRIPTION OF THE DRAWING FIGURES

DETAILED DESCRIPTION OF THE EMBODIMENTS

Figure 1A:
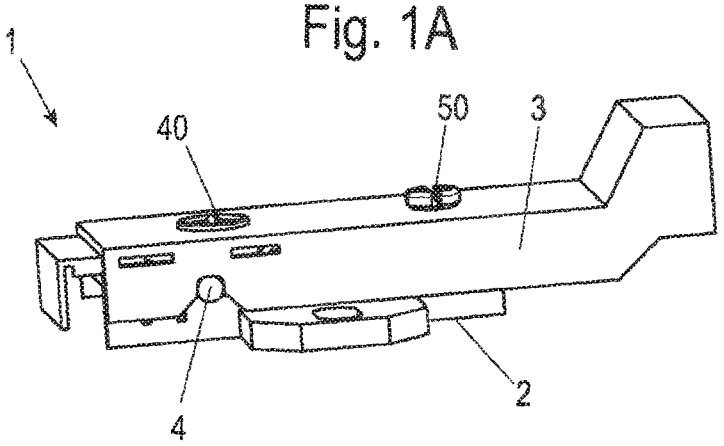
FIGS. 1A to 1C show three views of a hinge according to the invention in a mounted position, partially in section.
Figure 1B:
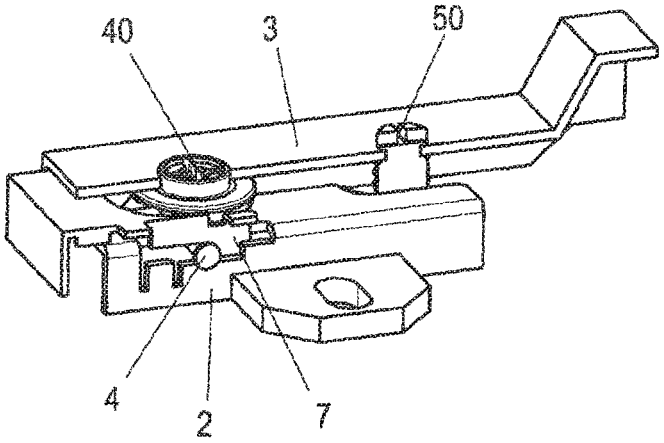
Figure 1C:
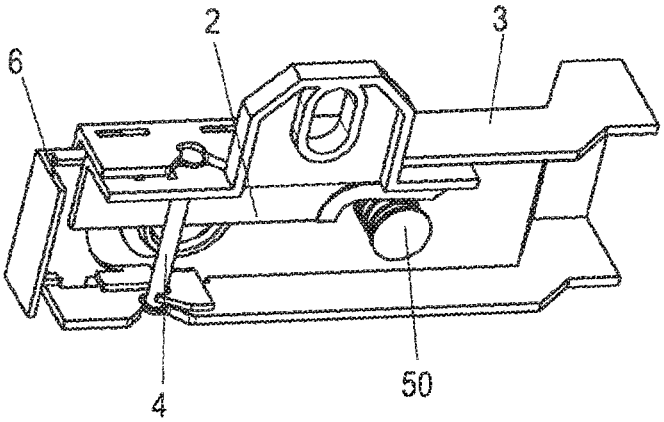

A hinge 1 comprises a mounting plate 2 and a side part 3, which are produced, for example, from a bent metal plate. A hinge part (not shown) is pivotably mounted on the side part 3, on which, for example, a door or a flap is fixed. The mounting plate 2 can be fixed on a side wall of a furniture body or on a domestic appliance. To align a door or flap in a closed position, the side part 3 is displaceably mounted via a depth adjustment unit 40 on the mounting plate 2 and is pivotably mounted via a vertical adjustment unit 50 on the mounting plate 2. A bolt 4 is provided for this purpose, which penetrates the mounting plate 2 and is used for mounting the side part 3.

Figure 2A:
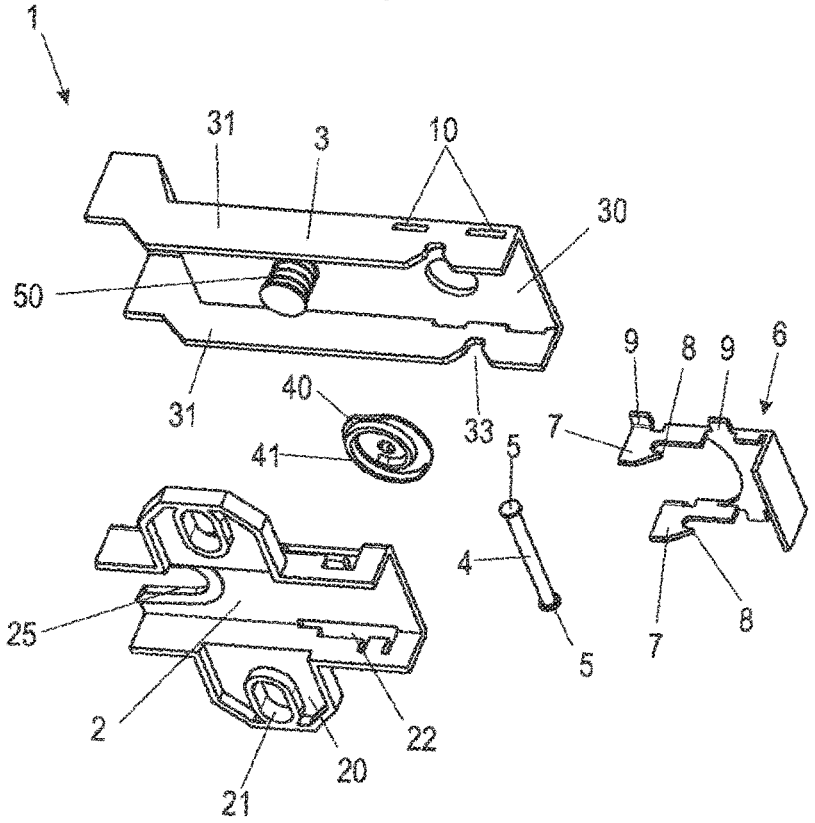
FIGS. 2A to 2C show multiple exploded illustrations of the hinge according to the invention.
Figure 2B:
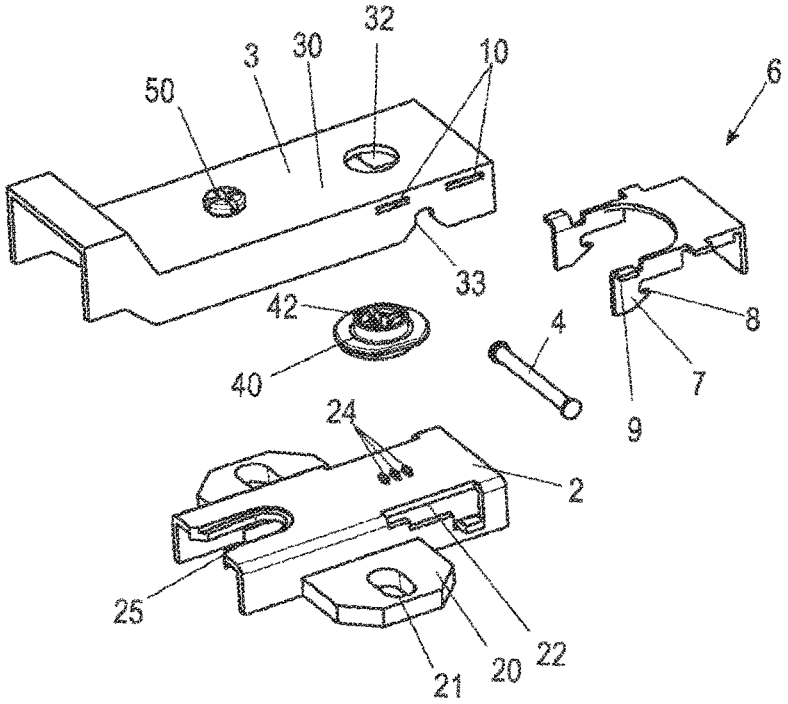
Figure 2C:
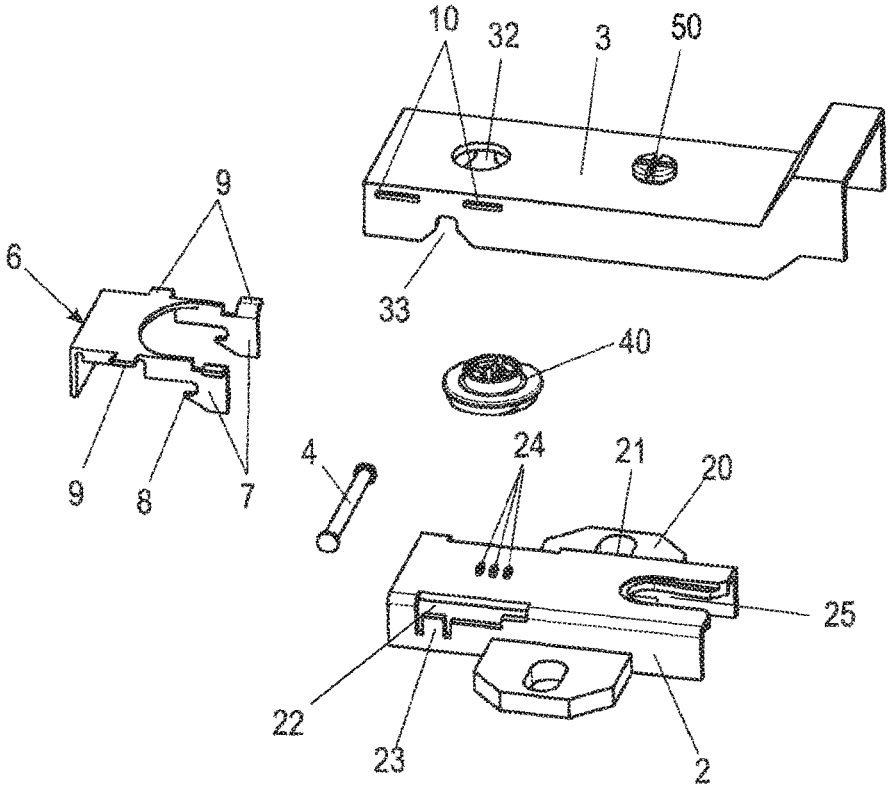

The hinge 1 is shown in various exploded illustrations in FIGS. 2A to 2C.

The mounting plate 2 comprises an oblong body, which is U-shaped in cross section and on which two arms 20 are provided laterally, which comprise openings 21 for fastening means. Alternatively, the mounting plate 2 can solely be embodied as an oblong body, wherein the fastening means are located in the oblong body, so that the two arms 20 can be omitted. A recess 22, which is penetrated by a bolt 4, is formed in each case on opposing sides in the oblong body. The bolt 4 comprises a thickened end section 5 in this case on opposing sides to effectuate captive securing of the bolt in the direction of its longitudinal axis. The mounting plate 2 furthermore comprises an oblong U-shaped receptacle 25, which is penetrated by a threaded bolt of the vertical adjustment unit 50. A threaded section of the vertical adjustment unit 50 is engaged in this case with lateral edges on the U-shaped receptacle 25, so that an adjustment of the side part 3 in relation to the mounting plate 2 is performed by rotating the threaded section. In this case, the threaded bolt of the vertical adjustment unit 50 is rotatably mounted via an offset pin 51 in the side part 3. Alternatively, a thread can be provided in the side part 3, so that, for example, an offset pin 51 can be inserted into the U-shaped receptacle 25 of the mounting plate. The vertical adjustment unit 50, which is formed as a bolt having external thread, is arranged so it is rotatable but is not axially displaceable on the side part 3, for example, by pressing the vertical adjustment unit 50 into an opening of the side part 3.

Furthermore, a catch element 6 is provided for fixing the side part 3 on the mounting plate 2, which catch element is formed as a U-shaped molded body and comprises a hook element 7 on two opposing legs, having a receptacle 8 into which the bolt 4 is insertable. Furthermore, laterally protruding webs 9 are formed on the catch element 6, which are insertable into slotted openings 10 on two legs 31 of the side part 3 or of the mounting plate 2.

The side part 3 is formed as an oblong component, which is U-shaped in cross section and comprises a transverse web 30, in which an opening 32 for inserting a depth adjustment unit is formed. Two angled legs 31 protrude on the transverse web 30, which at least partially enclose the mounting plate 2 and its oblong holes 22.

To be able to displace the side part 3 in relation to the mounting plate 2, a depth adjustment unit 40 is provided, which is formed as a worm and comprises a web-shaped worm 41 on the side facing toward the mounting plate 2. On the opposing side of the depth adjustment unit 40, a tool head 42 is provided, which is externally accessible. The depth adjustment unit 40 can be pressed into the opening 32 to be accommodated therein so it is rotatable but is not axially displaceable. The worm 41 facing toward the mounting plate 2 is engaged with one or more projections 24, which are formed on the upper side of the mounting plate 2.

Figure 3A:
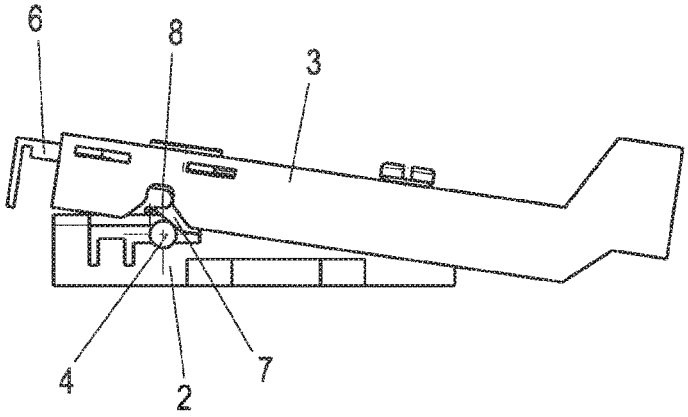
FIGS. 3A and 3B show two views of the hinge during the mounting.
Figure 3B:
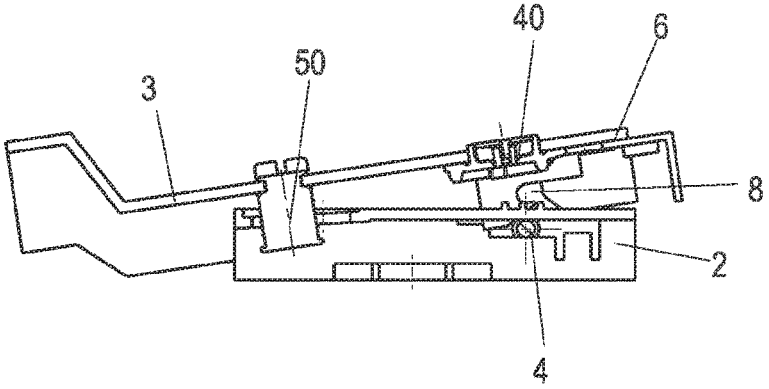

For the mounting, according to FIGS. 3A and 3B, firstly a bolt of the vertical adjustment unit 50 is positioned in the receptacle 25 of the mounting plate 2 and moreover the catch element 6 is latched between the side part 3 and the mounting plate 2. The preferably spring-loaded catch element is displaced or shifted by the bolt 4 in relation to the side part by corresponding intake bevels on the hook element 7. As soon as the bolt leaves the intake bevel, it locks in a receptacle 8 on the hook element 7. A displacement movement and/or size of the oblong hole 22 of the bolt 4 can then be delimited by bending over a tab 23 on the recess 22, so that the sliding range for the bolt 4 is reduced after the mounting of the side part 3 and/or the bolt 4 is held captively in the mounting plate. Alternatively, the bolt 4 can be provided with only one end section, so that the bolt 4 can be inserted into the recess 22. After the mounting procedure, the second end section is then produced, for example, by clinching. Alternative solutions for captively fastening the bolt 4 are also possible, so that the tab 23 can be omitted.

Figure 4A:
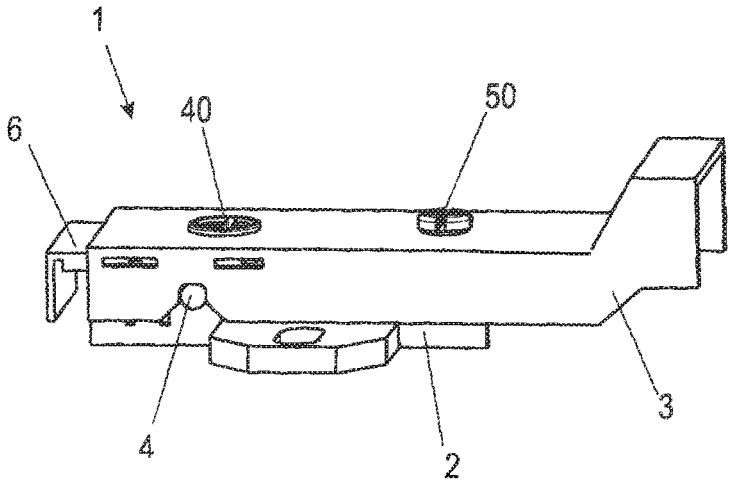
FIGS. 4A and 4B show two views of the hinge during the vertical adjustment.
Figure 4B:
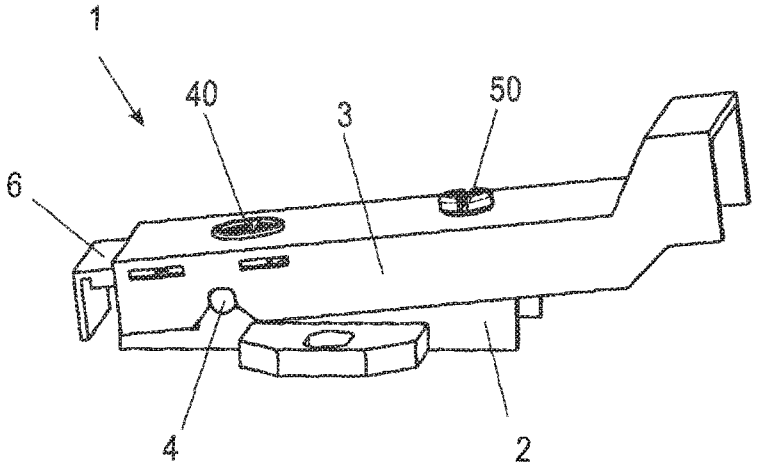

The hinge is shown in a mounted position in FIGS. 4A and 4B, wherein the side part 3 is arranged relatively flatly on the mounting plate 2 in the position of FIG. 4A, and in the illustration of FIG. 4B, an adjustment movement was performed via the vertical adjustment unit 50, during which the side part 3 was pivoted around the bolt 4. The distance of the side part 3 has thus become greater on one side perpendicularly in relation to the bottom of the mounting plate 2.

Figure 5A:
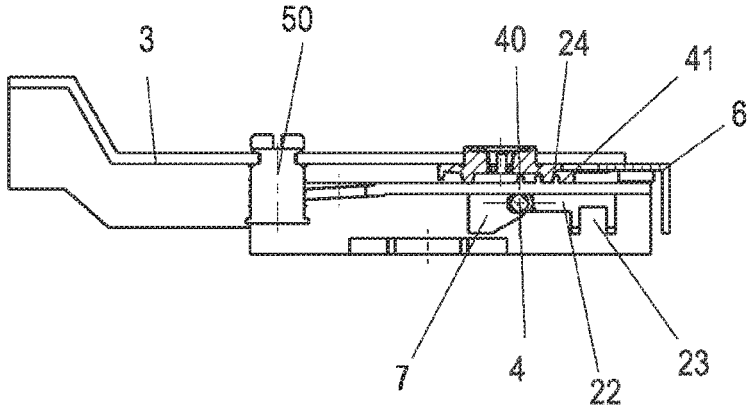
FIGS. 5A and 5B show two views of the hinge in section during the depth adjustment.
Figure 5B:
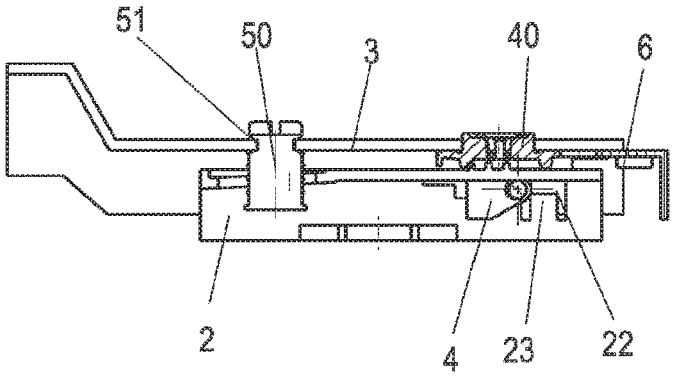
Figure 6A:
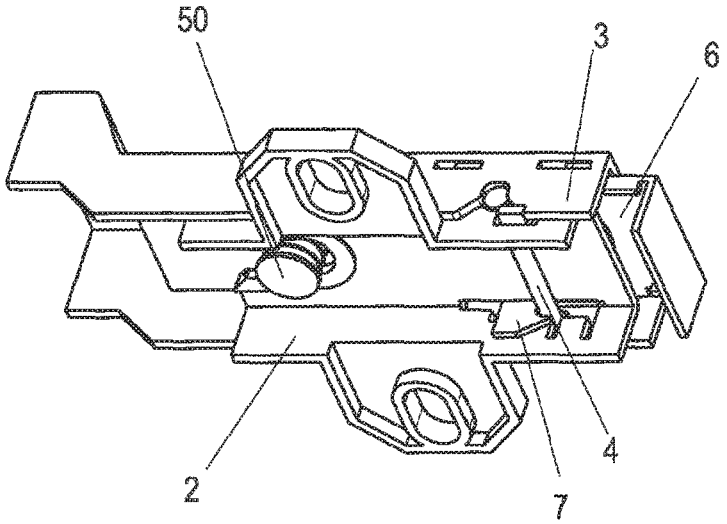
FIGS. 6A and 6B show two views of the hinge during the depth adjustment.
Figure 6B:
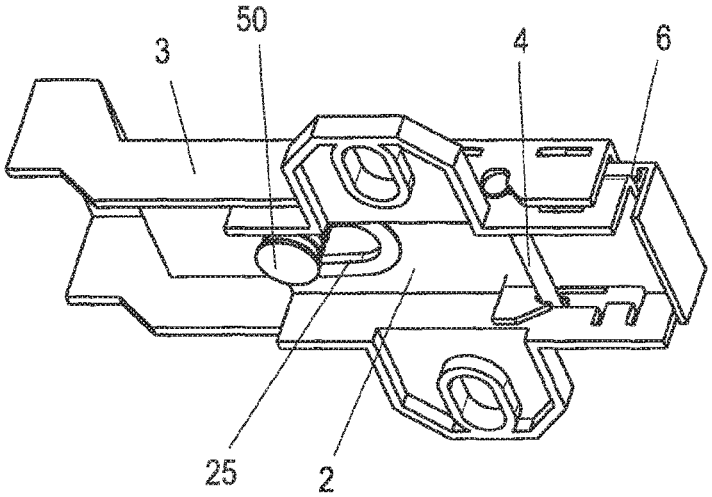

FIGS. 5A and 5B show two sectional views, from which the function of the depth adjustment unit 40 may be seen. The depth adjustment unit 40 comprises the downwardly protruding worm 41, which is engaged with the projections 24. By rotating the worm of the depth adjustment unit 40, the unit made of catch element 6, bolt 4, and side part 3 can thus be displaced in relation to the mounting plate 2. While the bolt 4 is arranged all the way to the left in the oblong hole 22 in FIG. 5A, it is located all the way to the right in FIG. 5B and presses against the bent-over tab 23. The vertical adjustment unit 50 is also displaced in the receptacle 25 by the displacement movement of the side part 3, as is recognizable from FIGS. 6A and 6B. A threaded section of the vertical adjustment unit 50 can nonetheless remain engaged with the U-shaped receptacle 25, so that a vertical adjustment can also be performed independently of the position of the side part 3 in relation to the mounting plate 2.

Figure 7A:
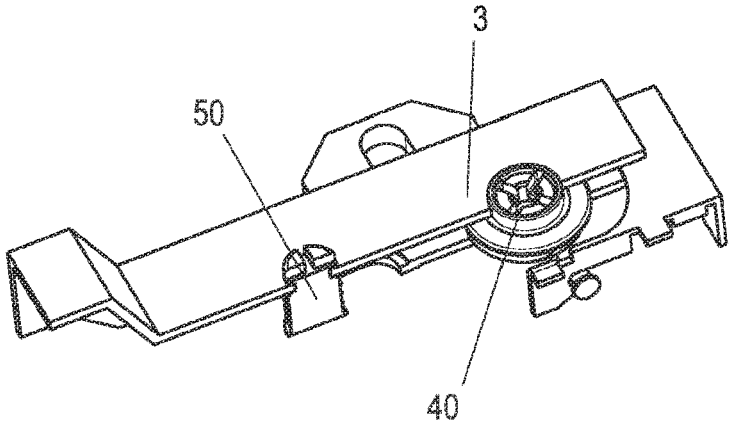
FIGS. 7A and 7B show two views of the hinge in section.
Figure 7B:
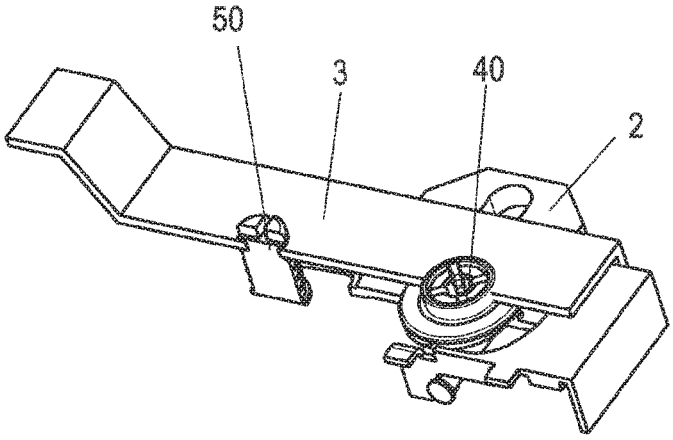

Two sectional views, which show the vertical adjustment unit 50 and the depth adjustment unit 40, are shown in FIGS. 7A and 7B. Both the depth adjustment unit 40 and also the vertical adjustment unit 50 comprise a bolt-shaped section, which is arranged in an opening on the side part 3 so it is rotatable but is not axially displaceable. This can be performed by corresponding deformation of the side part 3, for example, by pressing in the vertical adjustment unit 50 and the depth adjustment unit 40.

In the illustrated exemplary embodiment, the depth adjustment unit 40 is formed by a worm. Alternatively, an eccentric or another adjustment mechanism can also be used. Moreover, the bolt 4 is displaceably held on the mounting plate 2, and the catch element 6 is fixed on the side part 3. Of course, it is also possible to provide the bolt on the side part 3 and to mount the catch element 6 displaceably on the mounting plate 2.

LIST OF REFERENCE SIGNS

1 hinge
2 mounting plate

3 side part
4 bolt
5 end section
6 catch element
7 hook element
8 receptacle
9 web
10 opening
20 arm
21 opening
22 oblong hole
23 tab
24 projection
25 receptacle
30 bottom
31 leg
32 opening
40 depth adjustment unit
41 worm
42 tool head
50 vertical adjustment unit
51 pin

What is claimed is:

1. A hinge (1), comprising a mounting plate (2) fixable on a body or door and a side part (3), which is held on the mounting plate (2) and on which a hinge part is pivotably mounted, wherein the side part (3) is displaceable on the mounting plate (2) in a longitudinal direction via a depth adjustment unit (40) and the side part (3) is pivotable in relation to the mounting plate (2) by a height adjustment unit (50), wherein the side part (3) is fixed on the mounting plate (2) via a catch element (6) and is latched with a bolt (4), wherein the bolt is mounted in the mounting plate so as to be displaceable in the longitudinal direction, wherein the catch element (6) comprises at least one hook element (7), which partially encloses the bolt (4), wherein the side part (3) is rotatably mounted around the bolt (4) for a height adjustment, and wherein the side part (3) is mounted to the mounting plate by the catch element (6) and secured against lifting off from the mounting plate (2).

2. The hinge according to claim 1, wherein the catch element (6) and the bolt (4) and the side part form a unit, which is held displaceably on the mounting plate.

3. The hinge according to claim 1, wherein a recess (22), which is penetrated by the bolt (4), is provided in the mounting plate (2).

4. The hinge according to claim 1, wherein the catch element (6) is mounted on the side part (3).

5. The hinge according to claim 4, wherein webs (9), which are inserted into openings (10) on the side part (3) for mounting the catch element (6) on the side part (3), are formed on the catch element (6).

6. The hinge according to claim 1, wherein the catch element (6) is formed as a U-shaped molded part, which comprises the hook element (7) on two legs, which each engage behind the bolt (4) and secure the side part (3) against lifting off from the mounting plate (2).

7. The hinge according to claim 1, wherein the depth adjustment unit (40) comprises a rotatable cam, in which one or more projections (24) engage.

8. The hinge according to claim 6, wherein the cam is pressed in captively on an opening (32) of the side part (3).

9. The hinge according to claim 1, wherein the vertical adjustment unit (50) comprises a threaded bolt, which is held so it is rotatable but is not axially displaceable on an opening of the side part (3).

10. The hinge according to claim 1, wherein the vertical adjustment unit (50) comprises a threaded bolt, which is held with a threaded section on a U-shaped receptacle (25) of the mounting plate (2).

11. The hinge according to claim 3, wherein the displaceable bolt (4) is captively guided in the recess (22).

12. The hinge according to claim 11, wherein the displaceable bolt (4) comprises end sections (5), which are part of the captive securing.

* * * * *